US010674273B2

(12) United States Patent
Endo et al.

(10) Patent No.: US 10,674,273 B2
(45) Date of Patent: Jun. 2, 2020

(54) SPEAKER UNIT AND ACOUSTIC DEVICE

(71) Applicant: SONY CORPORATION, Tokyo (JP)

(72) Inventors: Katsuya Endo, Kanagawa (JP); Yoshiyuki Kaku, Tokyo (JP); Terutaka Yana, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/091,211

(22) PCT Filed: Mar. 16, 2017

(86) PCT No.: PCT/JP2017/010683
§ 371 (c)(1),
(2) Date: Oct. 4, 2018

(87) PCT Pub. No.: WO2017/183370
PCT Pub. Date: Oct. 26, 2017

(65) Prior Publication Data

US 2019/0116425 A1 Apr. 18, 2019

(30) Foreign Application Priority Data

Apr. 20, 2016 (JP) ..... 2016-084615

(51) Int. Cl.
*H04R 9/02* (2006.01)
*H04R 1/34* (2006.01)
(Continued)

(52) U.S. Cl.
CPC ..... *H04R 9/025* (2013.01); *H04R 1/025* (2013.01); *H04R 1/24* (2013.01); *H04R 1/34* (2013.01);
(Continued)

(58) Field of Classification Search
CPC . H04R 1/025; H04R 1/24; H04R 1/34; H04R 1/345; H04R 1/26; H04R 9/025; H04R 9/06; H04R 2499/15
(Continued)

(56) References Cited

U.S. PATENT DOCUMENTS 4,112,256 A 9/1978 Carlsson
2010/0059309 A1* 3/2010 Kajihara ..... H04R 7/12 181/169
(Continued)

FOREIGN PATENT DOCUMENTS

AU 7265374 A 2/1976
CA 1017256 A 9/1977
(Continued)

OTHER PUBLICATIONS

International Search Report and Written Opinion of PCT Application No. PCT/JP2017/010683, dated May 30, 2017, 07 pages of ISRWO.

*Primary Examiner* — Alexander Krzystan
(74) *Attorney, Agent, or Firm* — Chip Law Group

(57) ABSTRACT

A good output state of sound is ensured without a cost increase. A speaker unit includes: a vibration plate; a magnetic circuit; a bobbin to which an inner peripheral portion of the vibration plate is attached and which is varied in an axial direction by the magnetic circuit; and a cap attached to the vibration plate and located to face the bobbin in the axial direction of the bobbin, in which a center axis of the bobbin is arranged in a state of being inclined with respect to a horizontal plane or a vertical plane, and the cap is formed in a shape eccentric to the center axis of the bobbin. Thus, since the cap is eccentric to the center axis in a state in which the center axis of the bobbin is inclined with respect to the horizontal plane or the vertical plane, it is possible to freely control a pointing direction in an inclined direction, good
(Continued)

directivity characteristics can be obtained, and a good output state of sound can be ensured without a cost increase.

16 Claims, 10 Drawing Sheets

(51) Int. Cl.
*H04R 1/02* (2006.01)
*H04R 1/24* (2006.01)
*H04R 9/06* (2006.01)
*H04R 1/26* (2006.01)

(52) U.S. Cl.
CPC ..... *H04R 1/345* (2013.01); *H04R 9/06* (2013.01); *H04R 1/26* (2013.01); *H04R 2499/15* (2013.01)

(58) Field of Classification Search
USPC ..... 381/189, 391, 395, 337
See application file for complete search history.

(56) References Cited

U.S. PATENT DOCUMENTS

| | | | | |
|---|---|---|---|---|
| 2011/0002488 | A1* | 1/2011 | Van Daele | H04R 5/02 381/307 |
| 2011/0019864 | A1* | 1/2011 | Yamagishi | H04R 1/345 381/412 |
| 2015/0289038 | A1* | 10/2015 | Zartarian | H04R 3/04 381/103 |

FOREIGN PATENT DOCUMENTS

| | | | |
|---|---|---|---|
| DE | 2439935 | A1 | 3/1975 |
| DK | 450774 | A | 4/1975 |
| FR | 2241940 | A1 | 3/1975 |
| GB | 1484632 | A | 9/1977 |
| IT | 1020162 | B | 12/1977 |
| JP | 50-073624 | A | 6/1975 |
| JP | 50-73624 | A | 6/1975 |
| JP | 2006-303777 | A | 11/2006 |
| JP | 2006-303778 | A | 11/2006 |
| NL | 7411352 | A | 2/1975 |
| SE | 387511 | B | 9/1976 |

* cited by examiner

SPEAKER UNIT AND ACOUSTIC DEVICE

CROSS REFERENCE TO RELATED APPLICATIONS

This application is a U.S. National Phase of International Patent Application No. PCT/JP2017/010683 filed on Mar. 16, 2017, which claims priority benefit of Japanese Patent Application No. JP 2016-084615 filed in the Japan Patent Office on Apr. 20, 2016. Each of the above-referenced applications is hereby incorporated herein by reference in its entirety.

TECHNICAL FIELD

The present technology relates to a technical field of a speaker unit in which a vibration plate is vibrated by driving a magnetic circuit to output sound, and an acoustic device including the speaker unit.

CITATION LIST

Patent Document

Patent Document 1: Japanese Patent Application Laid-Open No. 2006-303778

BACKGROUND ART

There is a speaker unit which outputs sound amplified by an amplifier, and the speaker unit is assembled in a housing, thereby constituting an acoustic device. For example, there is a speaker unit configured so that a vibration plate is vibrated by a magnetic circuit having a magnet, a yoke, and a coil.

In addition to the magnetic circuit, such a speaker unit is provided with a bobbin which is varied in an axial direction by the magnetic circuit, a vibration plate vibrated in accordance with the variation of the bobbin, and a frame which holds the vibration plate and the magnetic circuit.

In the speaker unit, in order to ensure a good output state of sound, it is necessary to suppress deterioration of the sound quality or to improve directivity characteristics in a predetermined direction, and for example, there is a speaker unit in which a vibration plate is eccentric to a center axis of a bobbin in order to ensure such a good output state of sound (for example, refer to Patent Document 1).

In the speaker unit described in Patent Document 1, a main vibration plate and an auxiliary vibration plate are provided as a vibration plate, and the auxiliary vibration plate is attached to an inner peripheral portion of the main vibration plate. The main vibration plate and the auxiliary vibration plate are formed in a shape which is eccentric to the center axis of the bobbin at predetermined distances, respectively.

As described above, in the speaker unit described in Patent Document 1, since the main vibration plate and the auxiliary vibration plate are eccentric to the center axis of the bobbin, it is possible to suppress the occurrence of the resonance and broaden the band, thereby securing a good output state of sound.

SUMMARY OF THE INVENTION

Problems to be Solved by the Invention

Incidentally, in a case where the main vibration plate is formed in an eccentric shape as in the above-mentioned speaker unit, the shape of the frame for holding the main vibration plate also needs to be formed in a shape corresponding to the main vibration plate, which may be accompanied by a cost increase and design difficulty accordingly.

Further, in many cases, the speaker unit is arranged in a direction in which the axial direction of the bobbin becomes a front-rear direction so that an output direction of the sound is a front. However, depending on the speaker unit, the axial direction of the bobbin may be arranged in a direction different from the front-rear direction, and it is necessary to ensure a good output state of sound even in such a speaker unit.

In this regard, an object of a speaker unit and an acoustic device of the present technology is to overcome the above-mentioned problems and to ensure a good output state of sound without a cost increase.

Solutions to Problems

Firstly, a speaker unit includes: a vibration plate; a magnetic circuit; a bobbin to which an inner peripheral portion of the vibration plate is attached and which is varied in an axial direction by the magnetic circuit; and a cap attached to the vibration plate and located to face the bobbin in the axial direction of the bobbin, in which a center axis of the bobbin is arranged in a state of being inclined with respect to a horizontal plane or a vertical plane, and the cap is formed in a shape eccentric to the center axis of the bobbin.

As a result, the cap is eccentric to the center axis in a state in which the center axis of the bobbin is inclined with respect to the horizontal plane or the vertical plane.

Secondly, in the above-mentioned speaker unit, it is desirable that a direction which connects the center axis and an eccentric point of the cap coincides with an inclined direction of the center axis with respect to the horizontal plane or the vertical plane.

As a result, good directivity characteristics can be obtained with a simple configuration of the cap.

Thirdly, in the above-mentioned speaker unit, it is desirable that the cap is formed in a shape eccentric to a front side with respect to the center axis.

As a result, good directivity characteristics are obtained in the inclined direction.

Fourthly, in the above-mentioned speaker unit, it is desirable that, in a predetermined line segment passing through the eccentric point on an outer surface of the cap, one of the line segment is formed in an arc shape with the eccentric point as a reference, and the other of the line segment is formed as a curved line in which a curvature increases as the other of the line segment is separated from the eccentric point.

As a result, the cap is formed into a shape that can obtain good directivity characteristics.

Fifthly, in the above-mentioned speaker unit, it is desirable that the predetermined line segment is set as a line segment included in a center plane in a right-left direction.

As a result, all the line segments in which the outer surface of the cap intersects the center plane in the right-left direction have a curved line shape.

Sixthly, in the above-mentioned speaker unit, it is desirable that a line segment on a rear side with the eccentric point as a reference is formed in an arc shape, and a line segment on a front side with the eccentric point as a reference is formed as a curved line in which the curvature increases as the line segment is separated from the eccentric point.

As a result, only a part of the line segment of the intersection line, which is a curved line segment in which the outer surface of the cap intersects the central surface in the right-left direction, becomes a curved line in which a curvature varies.

Seventhly, in the above-mentioned speaker unit, it is desirable that when an inclination angle of the center axis with respect to the horizontal plane or the vertical plane is set as an angle X, a line segment which connects one end and the other end in a direction connecting the center axis of the cap and the eccentric point is set as a coupling line, a line segment passing through an intermediate point of the coupling line and extending in the axial direction of the center axis is set as a line segment B, and a line segment obtained by inclining the line segment B by an angle of (90°−angle X)/2 with the intermediate point as a reference is set as a line segment C, the eccentric point exists on the line segment C.

As a result, the eccentric point is formed at a predetermined position of the intersection line.

Eighthly, it is desirable that the above-mentioned speaker unit includes: a frame to which an edge of the vibration plate is attached, the frame being provided with an attachment target portion attached to the housing of the acoustic device in the inclined state.

As a result, the speaker unit is in an inclined state with a simple structure.

An acoustic device according to the present technology includes: a speaker unit which outputs sound; and a housing to which the speaker unit is attached, in which the speaker unit includes a vibration plate, a magnetic circuit, a bobbin to which an inner peripheral portion of the vibration plate is attached and which is varied in an axial direction by the magnetic circuit, and a cap attached to the vibration plate and located to face the bobbin in the axial direction of the bobbin, a center axis of the bobbin is arranged in a state of being inclined with respect to a horizontal plane or a vertical plane, and the cap is formed in a shape eccentric to the center axis of the bobbin.

As a result, in the speaker unit, the cap is eccentric to the center axis in a state in which the center axis of the bobbin is inclined with respect to the horizontal plane or the vertical plane.

Tenthly, in the above-mentioned acoustic device, it is desirable that a direction which connects the center axis and an eccentric point of the cap coincides with an inclined direction of the center axis with respect to the horizontal plane or the vertical plane.

As a result, good directivity characteristics can be obtained with a simple configuration of the cap.

Eleventhly, in the above-mentioned acoustic device, it is desirable that the cap is formed in a shape eccentric to a front side with respect to the center axis.

As a result, good directivity characteristics are obtained in the inclined direction.

Twelfthly, in the above-mentioned acoustic device, it is desirable that, in a predetermined line segment passing through the eccentric point on an outer surface of the cap, one of the line segment is formed in an arc shape with the eccentric point as a reference, and the other of the line segment is formed as a curved line in which a curvature increases as the other of the line segment is separated from the eccentric point.

As a result, the cap is formed into a shape that can obtain good directivity characteristics.

Thirteenthly, in the above-mentioned acoustic device, it is desirable that the predetermined line segment is set as a line segment included in a center plane in a right-left direction.

As a result, all the line segments in which the outer surface of the cap intersects the center plane in the right-left direction have a curved line shape.

Fourteenthly, in the above-mentioned acoustic device, it is desirable that a line segment on a rear side with the eccentric point as a reference is formed in an arc shape, and a line segment on a front side with the eccentric point as a reference is formed as a curved line in which the curvature increases as the line segment is separated from the eccentric point.

As a result, only a part of the line segment of the intersection line, which is a curved line segment in which the outer surface of the cap intersects the central surface in the right-left direction, becomes a curved line in which the curvature varies.

Fifteenthly, in the above-mentioned acoustic device, it is desirable that when an inclination angle of the center axis with respect to the horizontal plane or the vertical plane is set as an angle X, a line segment which connects one end and the other end in a direction connecting the center axis of the cap and the eccentric point is set as a coupling line, a line segment passing through an intermediate point of the coupling line and extending in the axial direction of the center axis is set as a line segment B, and a line segment obtained by inclining the line segment B by an angle of (90°−angle X)/2 with the intermediate point as a reference is set as a line segment C, the eccentric point exists on the line segment C.

As a result, the eccentric point is formed at a predetermined position of the intersection line.

Sixteenthly, it is desirable that the above-mentioned acoustic device includes: a frame to which an edge of the vibration plate is attached, the frame being provided with an attachment target portion attached to the housing of the acoustic device in the inclined state.

As a result, the speaker unit is inclined with a simple structure.

Seventeenthly, in the above-mentioned acoustic device, it is desirable that the acoustic device is usable in a first direction placed on a placement surface and in a second direction different by approximately 90° from the first direction.

As a result, it is possible to control directivity in accordance with the direction of use of the first direction and the second direction.

Effects of the Invention

According to the present technology, since the cap is eccentric to the center axis in a state in which the center axis of the bobbin is inclined with respect to the horizontal plane or the vertical plane, it is possible to freely control a pointing direction in an inclined direction, good directivity characteristics can be obtained, and a good output state of sound can be ensured without cost increase.

Incidentally, the effects described in the present specification are merely examples and are not limited, and other effects may be provided.

MODE FOR CARRYING OUT THE INVENTION

Hereinafter, modes for carrying out a speaker unit and an acoustic device of the present technology will be described with reference to the attached drawings.

<Configuration and the Like of Acoustic Device>

First, the configuration and the like of the acoustic device will be described (see FIGS. 1 and 2).

Figure 1:
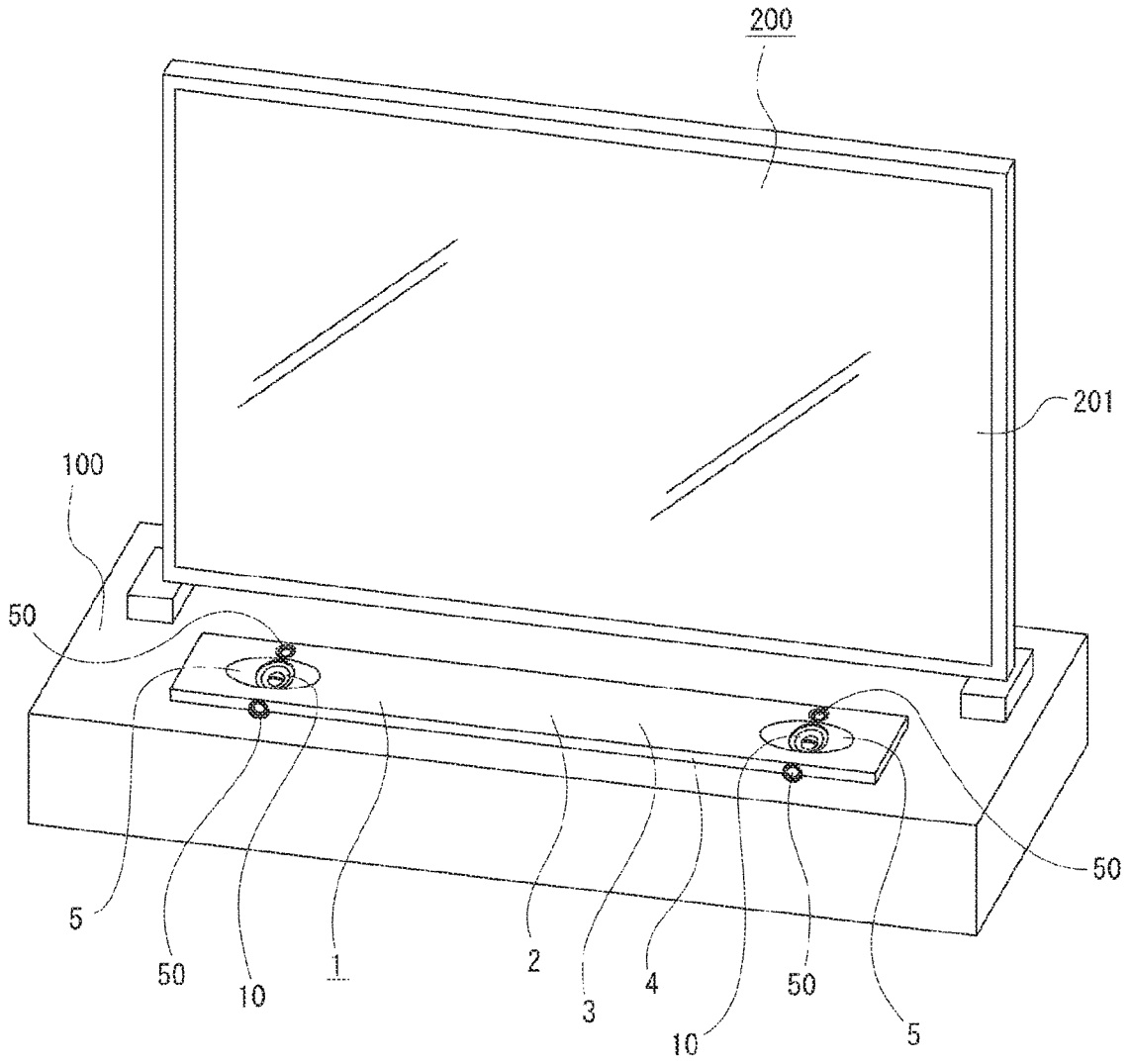
FIG. 1 illustrates an embodiment of a speaker unit and an acoustic device of the present technology together with FIGS. 2 to 11, which is a perspective view illustrating the acoustic device together with a television.

An acoustic device 1 is placed, for example, on a placement surface 100 such as an upper surface of a TV stand or an upper surface of a table, together with another electronic device such as a television 200 (see FIG. 1). For example, the acoustic device 1 is arranged in front of the television 200, and the sound of the television 200 is output from the acoustic device 1.

The acoustic device 1 includes a horizontally elongated housing 2 along a width direction of a screen 201 of the television 200, and the housing 2 has a base arrangement portion 3 facing forward to be diagonally upward, and a front arrangement portion 4 facing forward and continued to a front edge of the base arrangement portion 3.

Figure 2:
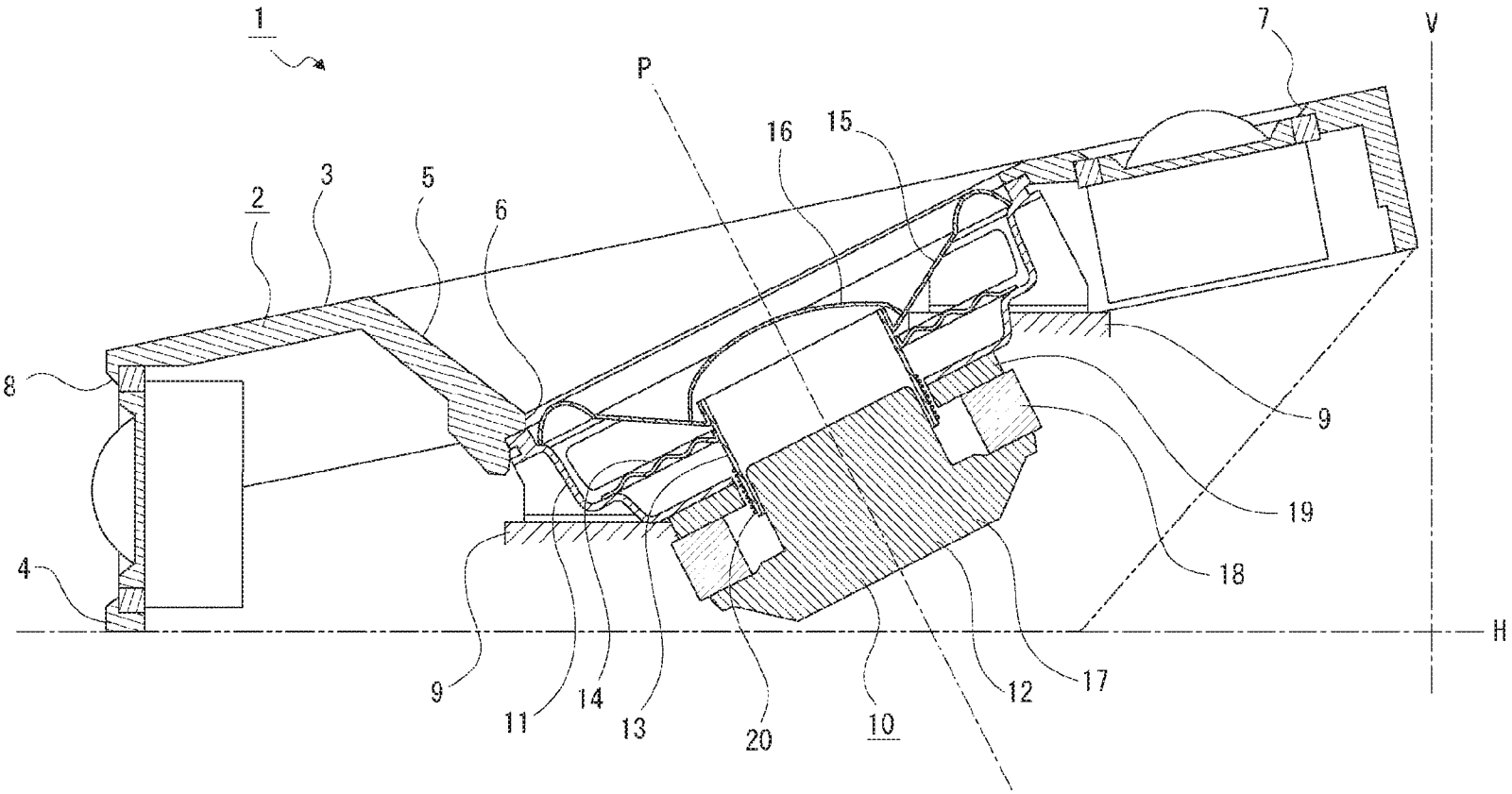
FIG. 2 is a cross-sectional view of the acoustic device.

In the base arrangement portion 3, mortar-shaped concave portions 5 and 5 which are opened upward are formed to be spaced apart from each other in a right-left direction, and first arrangement holes 6 and 6 opened vertically are formed in the concave portions 5 and 5 (see FIG. 2). The first arrangement hole 6 is formed in a circular shape, and is inclined forwardly downward so that an opening edge is displaced downward as going forward.

Second arrangement holes 7 and 7 are formed in the base arrangement portion 3 on the rear side of the concave portions 5 and 5, respectively. Third arrangement holes 8 and 8 are formed in the front arrangement portion 4 on the front side of the concave portions 5 and 5, respectively.

Four attachment portions 9, 9, . . . are provided below the concave portions 5 and 5 inside the housing 2 so as to be separated from each other in a front-rear direction and the right-left direction.

Speaker units 10 and 10 and speaker units 50, 50, . . . are attached to the housing 2, and the acoustic device 1 is configured by attaching the speaker units 10 and 10 and the speaker units 50, 50, . . . to the housing 2. The speaker units 10 and 10 are arranged in the first arrangement holes 6 and 6 respectively, the two speaker units 50 and 50 are arranged in the second arrangement holes 7 and 7 respectively, and the other two speaker units 50 and 50 are arranged in the third arrangement holes 8 and 8, respectively.

The speaker unit 10 is used, for example, as a woofer, and the speaker unit 50 is used, for example, as a tweeter. Sound is output substantially upward from the speaker units 50 and 50 arranged in the second arrangement holes 7 and 7, respectively, and sound is output substantially forward from the speaker units 50 and 50 arranged in the third arrangement holes 8 and 8, respectively.

A height of the speaker unit 10 is smaller than a distance from a lower end of the television 200 to a lower end of the screen 201 so that the screen 201 of the television 200 is not shielded by the speaker unit 10 when a viewer views the screen 201.

<Configuration of Speaker Unit>

Next, the configuration of the speaker unit 10 arranged in the first arrangement hole 6 will be described (see FIGS. 2 to 4).

Figure 3:
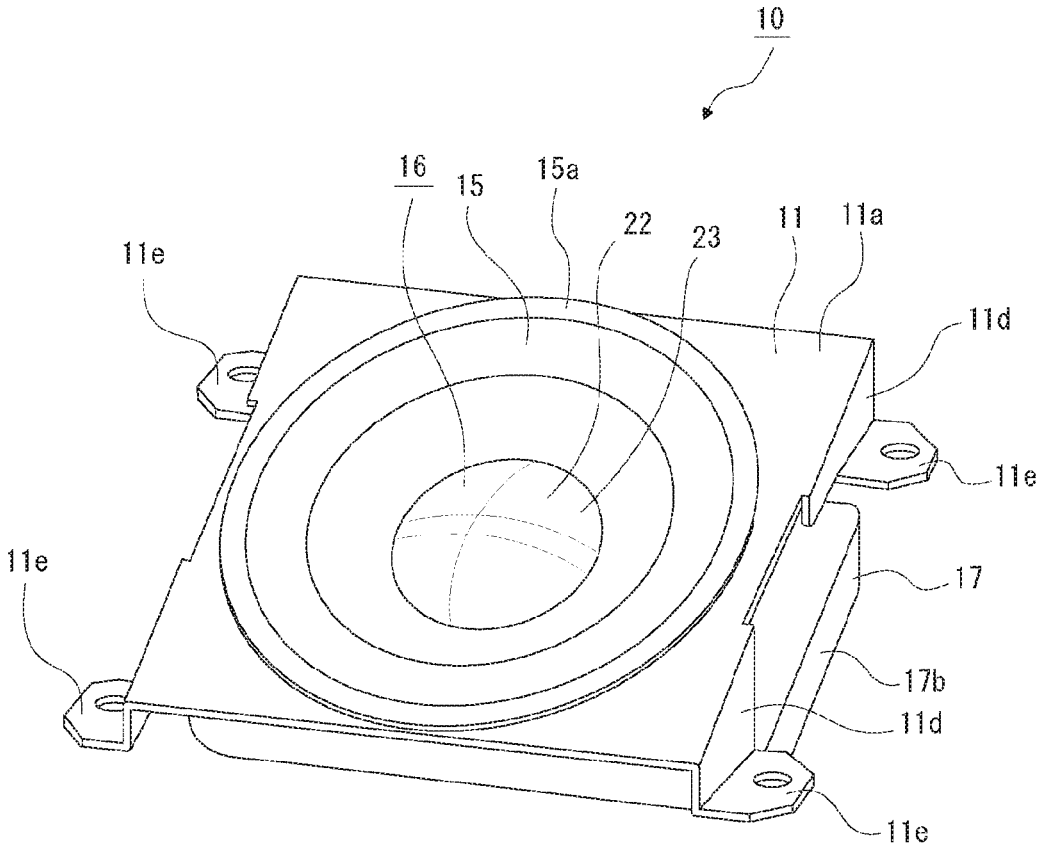
FIG. 3 is a perspective view of the speaker unit.
Figure 4:
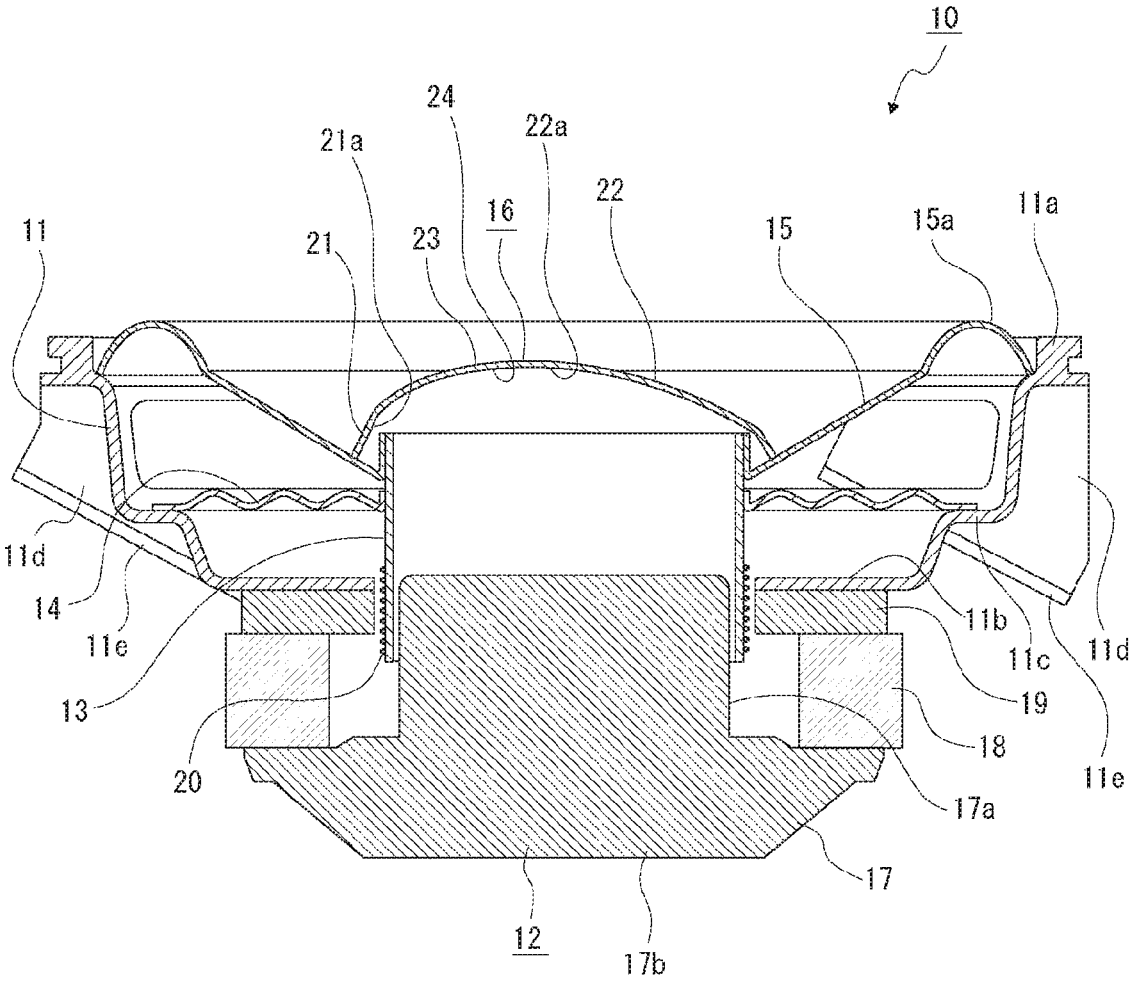
FIG. 4 is a cross-sectional view of the speaker unit.

The speaker unit 10 has a frame 11, a magnetic circuit 12, a bobbin 13, a damper 14, a vibration plate 15, and a cap 16 (see FIGS. 3 and 4).

The frame 11 is formed in an annular shape as a whole by a material having high rigidity such as a metal material, one end portion in an axial direction is provided as an attachment holding portion 11*a* having the largest outer shape, and the other end portion in the axial direction is provided as a plate attachment portion 11*b* having the smallest outer shape. The frame 11 is provided with a stepped surface-shaped coupling portion 11*c* between the attachment holding portion 11*a* and the plate attachment portion 11*b*.

The attachment holding portion 11*a* has an outer shape formed in a rectangular shape. The frame 11 is provided with connecting portion 11*d*, 11*d*, . . . protruding from the four corner portions of the attachment holding portion 11*a* in the same direction orthogonal to the attachment holding portion 11*a*, and attachment target portions 11*e*, 11*e*, . . . protruding outward from the connecting portions 11*d*, 11*d*, . . . , respectively. The attachment target portions 11*e*, 11*e*, . . . are inclined with respect to the attachment holding portion 11*a*.

The magnetic circuit 12 has a yoke 17, a magnet 18, a plate 19, and a coil 20.

The yoke 17 has a cylindrical bobbin support portion 17*a*, and an attachment protrusion 17*b* protruding outward from one end portion of the bobbin support portion 17*a* in the axial direction. The magnet 18 is formed in an annular shape, and is attached to the attachment protrusion 17*b* in a state in which the bobbin support portion 17*a* is inserted to the interior of the magnet 18. The plate 19 is formed in an annular shape, and both surfaces of the plate 19 are attached to the magnet 18 and the plate attachment portion 11*b* of the frame 11, respectively, in a state in which the bobbin support portion 17*a* inserted to the interior of the plate 19.

The coil 20 is wound around an outer peripheral surface of the bobbin 13. The bobbin 13 is formed in a cylindrical shape, and the bobbin support portion 17*a* of the yoke 17 is partially inserted into the bobbin 13 so that the bobbin 13 can be varied in the axial direction with respect to the bobbin support portion 17*a*.

An inner peripheral portion of the damper 14 is coupled to the bobbin 13, and an outer peripheral portion thereof is coupled to the coupling portion 11*c* of the frame 11.

An inner peripheral portion of the vibration plate 15 is attached to one end portion of the bobbin 13 in the axial direction, and an edge 15*a* which is an outer peripheral portion is attached to and held by the attachment holding portion 11*a* of the frame 11.

The cap 16 has a function of suppressing entry of dust into the inside of the frame 11, for example, and is also referred to as a so-called dust cap.

The cap 16 is located to face one end portion of the bobbin 13 in the axial direction of the bobbin 13, and is formed in a shape having a concave portion opened to the bobbin 13 side.

The speaker unit 10 configured as described above is arranged in a state in which the attachment target portions 11*e*, 11*e*, . . . of the frame 11 are attached to the attachment portions 9, 9, . . . provided on the housing 2 by screwing or the like, and a center axis P of the bobbin 13 is inclined with respect to a horizontal plane H or a vertical plane V (see FIG. 2).

As described above, the speaker unit 10 is provided with the attachment target portions 11*e*, 11*e*, . . . attached to the frame 11 in the state of being inclined to the housing 2 of the acoustic device 1.

Therefore, since the speaker unit 10 is arranged in an inclined state by attaching the attachment target portions 11*d*, 11*d*, . . . , which are provided on the frame 11 to which the vibration plate 15 is attached, to the housing 2, it is possible to arrange the speaker unit 10 in a state of being easily inclined by a simple structure.

The speaker unit 10 is disposed in a state in which the center axis P of the bobbin 13 is inclined with respect to the vertical plane V by, for example, 27°, and is inclined with respect to the horizontal plane H (the placement surface 100) by, for example, 63°.

In the speaker unit 10, when a driving current is supplied to the coil 20, a thrust is generated in the magnetic circuit 12, the bobbin 13 is varied in the axial direction, the driving force of the bobbin 13 is transmitted to the vibration plate 15, and the vibration plate 15 and the cap 16 vibrate with variation of the bobbin 13. When the vibration plate 15 and the cap 16 vibrate, the output of the sound amplified by the amplifier is performed. At this time, excessive variation of the bobbin 13 is suppressed by the damper 14.

<Specific Shape of Cap>

Next, a specific shape of the cap 16 will be described (see FIGS. 5 to 7).

The cap 16 is made by integrally forming an annular base portion 21 having a substantially annular shape and a shallow container-shaped covering portion 22 provided to cover a hole 21*a* of the annular base portion 21 by a resin material or a rubber material. The covering portion 22 is formed in a convex shape on aside opposite to the bobbin 13, and a concave portion 22*a* is formed in the covering portion 22 on the side of the bobbin 13. Incidentally, the cap 16 may be integrally formed with the vibration plate 15.

The annular base portion 21 is a portion to be attached to the inner peripheral portion of the vibration plate 15.

Figure 6:
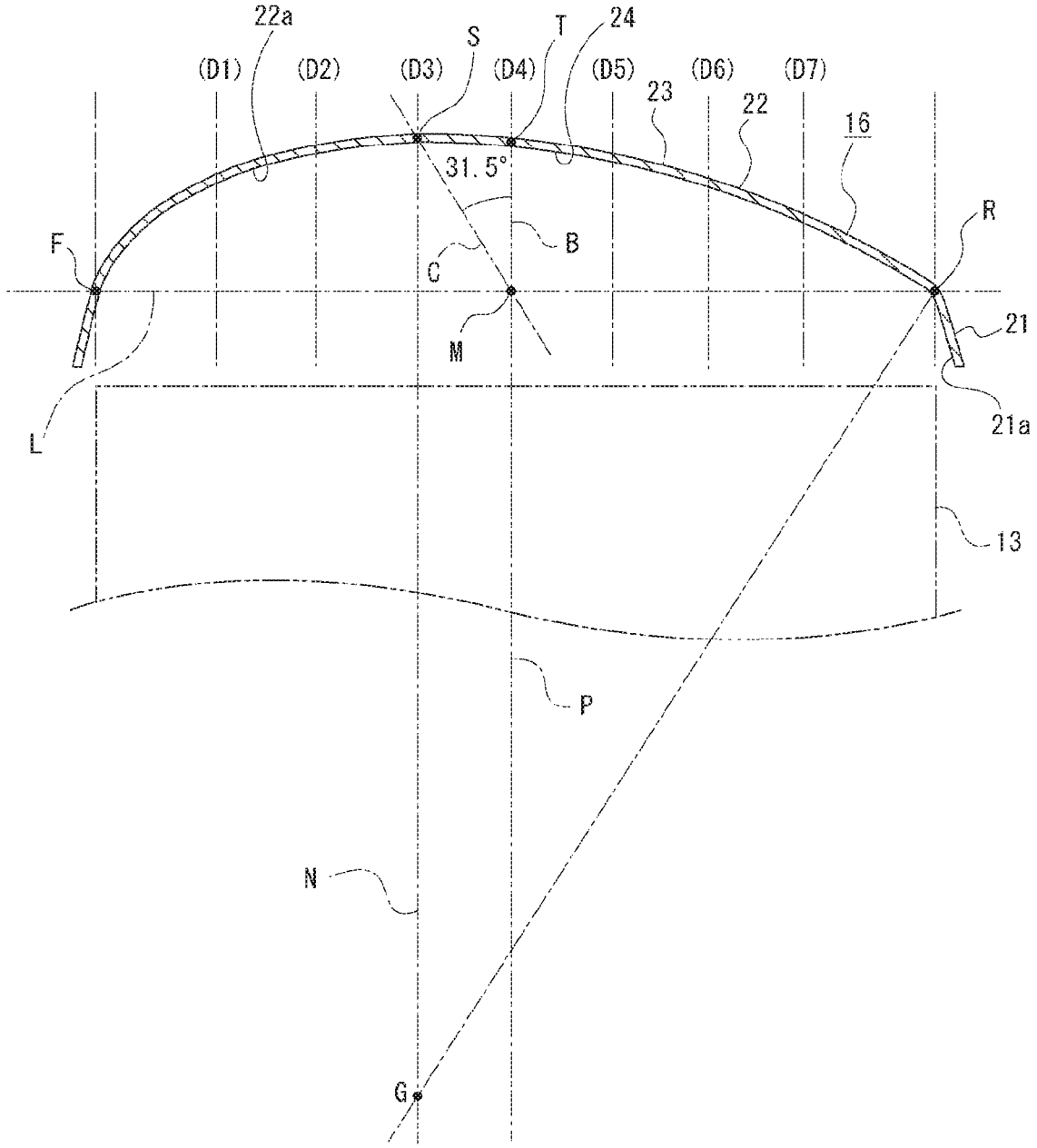
FIG. 6 is a schematic view of a cross-section of a center of the cap in a right-left direction.
Figure 7:
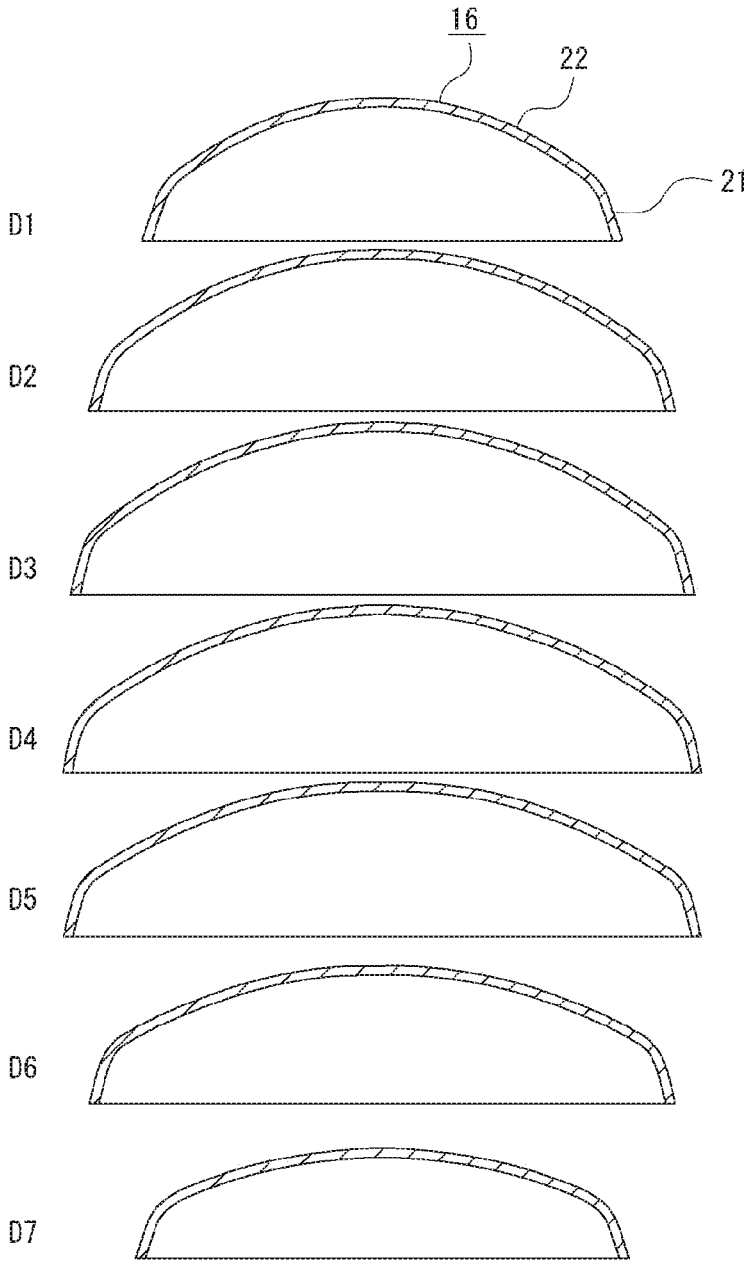
FIG. 7 is each cross-sectional view of a state in which the cap is cut in the right-left direction.

The covering portion 22 is formed in a gently curved shape in which an outer surface 23 facing the output direction of sound and an inner surface 24 facing the bobbin 13 have a substantially similar shape, and has a substantially uniform thickness (see FIG. 6).

Figure 5:
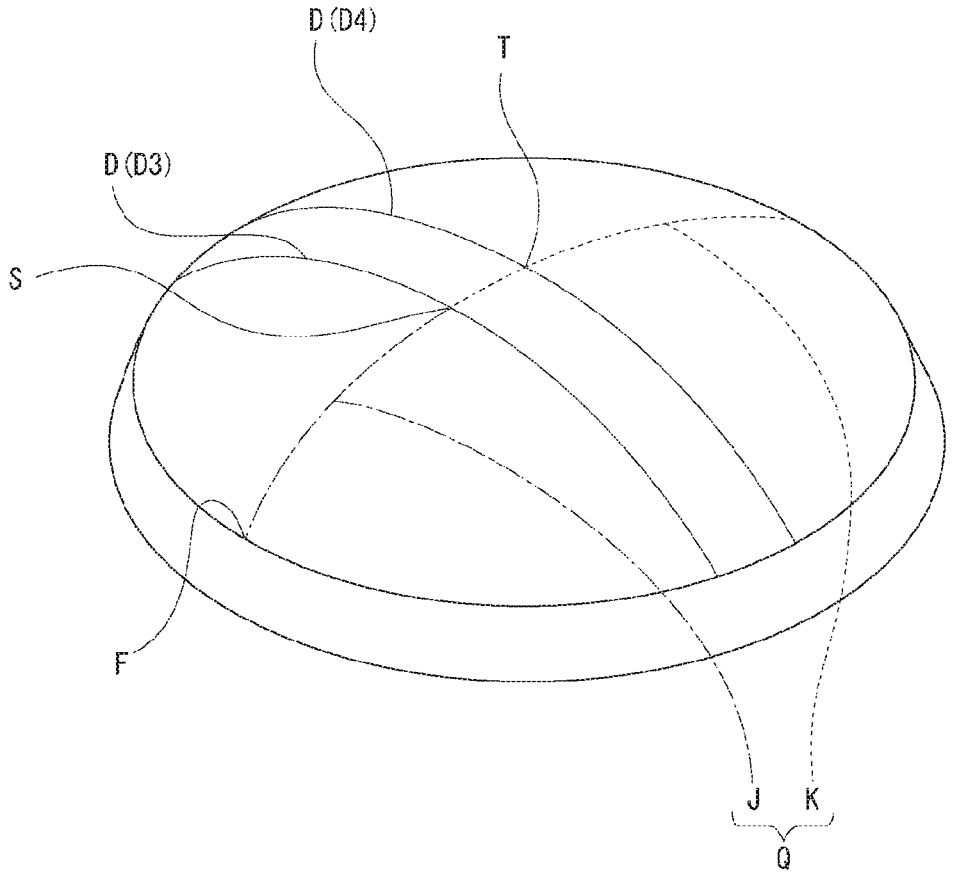
FIG. 5 is an enlarged perspective view of a cap.

The covering portion 22 is formed in a shape eccentric to the circular shape in a state of being viewed from the axial direction of the bobbin 13, and an eccentric point S exists at a position displaced to the front side with respect to the center axis P of the bobbin 13 (see FIGS. 5 and 6). When an intersection line between the outer surface 23 and the center plane of the covering portion 22 in the right-left direction is set as an intersection line Q, the eccentric point S exists on the intersection line Q. Further, when the center of a coupling line L which connects a front end F of the intersection line Q and a rear end R of the intersection line Q is set as an intermediate point M, the eccentric point S is located in front of the intermediate point M. The intermediate point M exists on the extension line of the center axis P.

In the intersection line Q, a curved line from the eccentric point S to the front end F is formed as a curved line J in which the curvature increases toward the front end F, and a curved line from the eccentric point S to the rear end R is formed as an arc-shaped curved line K. Therefore, the arc-shaped curved line K is an arc centered on a predetermined reference point G, and the reference point G exists on a line segment N passing through the eccentric point S and parallel to the center axis P.

When the intersection point between the intersection line Q and the extension line of the center axis P is set as an intersection point T, and the line segment from the intermediate point M to the intersection point T is set as a line segment B, the eccentric point S exists on a line segment C obtained by inclining the line segment B about the intermediate point M toward the front side of an angle Y. The eccentric point S is a contact point on which a plane orthogonal to the line segment N abuts, and is a point that exists at the highest position in the covering portion 22. The angle Y is defined by, for example, (90°−angle X)/2. The angle X is an inclination angle of the center axis P with respect to the horizontal plane H or the vertical plane V, and the angle Y is set to 31.5° in a case where the angle X is, for example, 27°.

In the cap 16, the covering portion 22 is formed in the shape as described above, and the intersection line Q is formed as follows.

First, the eccentric point S is determined by inclining the extension line of the center axis P by the angle Y with the intermediate point M as a reference. Next, a curved line between the eccentric point S and the rear end R is determined so that the eccentric point S becomes an arc of a curvature which is a contact point with respect to a plane orthogonal to the line segment N parallel to the center axis P, thereby forming the curved line K. Next, a curved line between the eccentric point S and the front end F is determined to have the large curvature toward the front end F, thereby forming the curved line J and forming the intersection line Q.

The respective intersection lines between the outer surface 23 and the front and rear cross-sections are formed as a curved line in which the curvature increases as the front portion of the covering portion 22 goes forward, similarly to the intersection line Q, and the rear portion thereof is formed as an arc-shaped curved line.

The intersection lines D, D, . . . , between the outer surface 23 and the respective right and left cross-sections of the covering portion 22, that is, intersection lines D1, D2, . . . , in each cross-section are formed in arc shapes with predetermined curvatures (see FIG. 7), respectively. The intersection points between all the intersection lines D1, D2, . . . and the intersection line Q are the center point in the right-left direction, and symmetrical in the right-left direction.

<Measurement Result on Directivity>

The measurement results on the directivity of the sound output from the speaker unit 10 will be described below (see FIG. 8).

Figure 8:
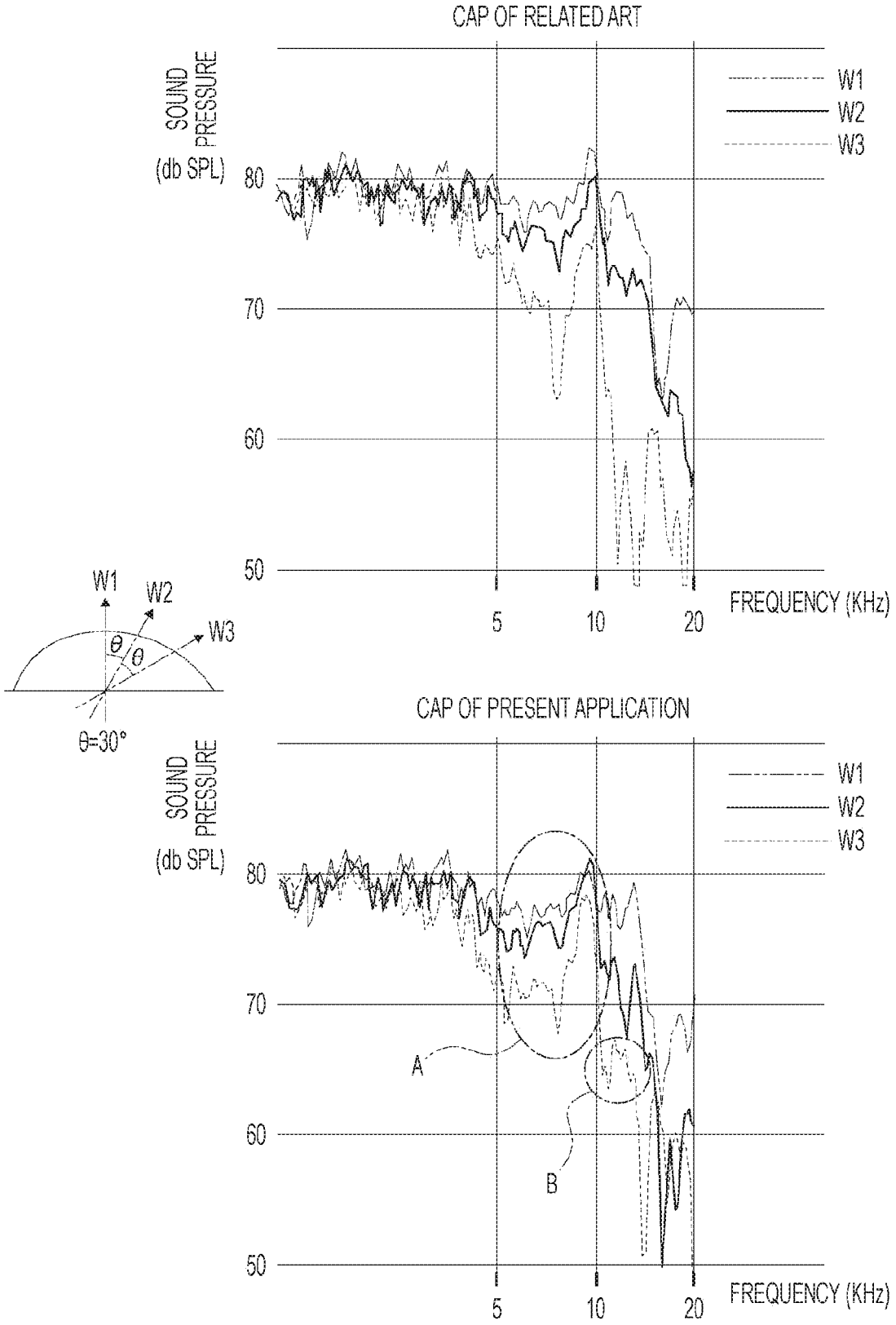
FIG. 8 is a graph showing measurement results relating to a sound pressure.

In a graph shown in FIG. 8, an upper graph is a measurement result on the directivity of a conventional speaker unit having a non-eccentric cap, and a lower graph is a measurement result on the directivity of the speaker unit 10 having the eccentric cap 16. The conventional non-eccentric cap has a circular outer shape, an apex of the covering portion is centered, and the apex exists on the extension line of the center axis of the bobbin.

The measurement result is a result in which a sound pressure W1 in the direction of the center axis (P) of the bobbin, a sound pressure W2 in the direction inclined rearward 30° with the intermediate point (M) as a reference, and a sound pressure W3 in the direction inclined rearward by 60° with the intermediate point (M) as a reference are measured for each frequency. A horizontal axis is the frequency (KHz), and a vertical axis is the sound pressure (db SPL).

As shown in FIG. 8, the speaker unit 10 has no particular difference in the sound pressure W1 as compared with the conventional speaker unit. However, a result in which the sound pressure W2 rises in the frequency band of 5 KHz to 10 KHz and the difference between the sound pressure W2 and the sound pressure W1 becomes smaller was obtained (see a broken line A in FIG. 8). Further, an increase in the sound pressure W3 was observed in the frequency band of 5 KHz to 10 KHz (see the broken line A in FIG. 8). Furthermore, an increase in the sound pressure W3 was observed in the frequency band of 10 KHz to 15 KHz (see a broken line B in FIG. 8).

Therefore, in the speaker unit 10, in particular, a result in which a high directivity in the direction inclined by 60° with respect to the center axis P of the bobbin 13 was ensured was obtained.

<Summary>

As described above, the speaker unit 10 is disposed in the state in which the center axis P of the bobbin 13 is inclined with respect to the horizontal plane H or the vertical plane V. The cap 16 is formed in a shape eccentric to the center axis P of the bobbin 13.

Therefore, in a state in which the center axis P of the bobbin 13 is inclined with respect to the horizontal plane H or the vertical plane V, the cap 16 is eccentric to the center axis P, it is possible to freely control the pointing direction in an inclined direction without changing the shape of the frame 11 or the like, a good directivity characteristic is obtained, and it is possible to ensure a good output state of the sound without causing a cost increase.

Further, since the direction which connects the center axis P and the eccentric point S of the cap 16 coincides with the inclined direction of the center axis P with respect to the horizontal plane H or the vertical plane V, a good directivity characteristic is obtained by the simple configuration of the cap 16 without a manufacturing cost increase, and it is possible to obtain a good sense of localization on the audibility.

Furthermore, since the cap 16 is formed in a shape eccentric toward the front side with respect to the center axis P of the bobbin 13, good directivity characteristics are obtained in the inclined direction, and it is possible to obtain a good sense of localization on the audibility in the inclined direction.

Furthermore, in the intersection line Q which is a predetermined line segment passing through the eccentric point S on the outer surface 23 of the cap 16, one thereof is formed as an arc-shaped curved line J with respect to the eccentric point S, and the other thereof is formed as a curved line J in which the curvature becomes larger as it is separated from the eccentric point S.

Therefore, the cap 16 is formed into a shape that can obtain good directivity characteristics, and it is possible to ensure a good sense of localization on audibility without forming the cap 16 in a complicated shape, and to ensure a good output state of sound.

Further, since the intersection line Q, which is a predetermined line segment, is a line segment included in the center plane in the right-left direction, all the line segments in which the outer surface 23 of the cap 16 intersects the center plane in the right-left direction have a curved shape, and it is possible to ensure a good sense of localization on audibility without forming the cap 16 in a complicated shape.

Further, in the intersection line Q, a line segment on the rear side with the eccentric point S as a reference is formed as an arc-shaped curved line K, and a line segment on the front side with the eccentric point S as a reference is formed as a curved line J in which the curvature increases as it is separated from the eccentric point S.

Therefore, only a part of the line segment of the intersection line Q, which is a curved line segment in which the outer surface 23 of the cap 16 intersects the center plane in the right-left direction, becomes a curved line in which the curvature varies, and it is possible to ensure a better sense of localization on audibility without forming the cap 16 in a complicated shape.

Furthermore, in the cap 16, when a line segment obtained by inclining the line segment B at an angle of (90°−angle X)/2 with the intermediate point M as a reference is set as a line segment C, since the eccentric point S exists on the line segment C, the eccentric point S is formed at a predetermined position of the intersection line Q, and it is possible to ensure a good sense of localization on audibility by the easy design of the cap 16.

Figure 9:
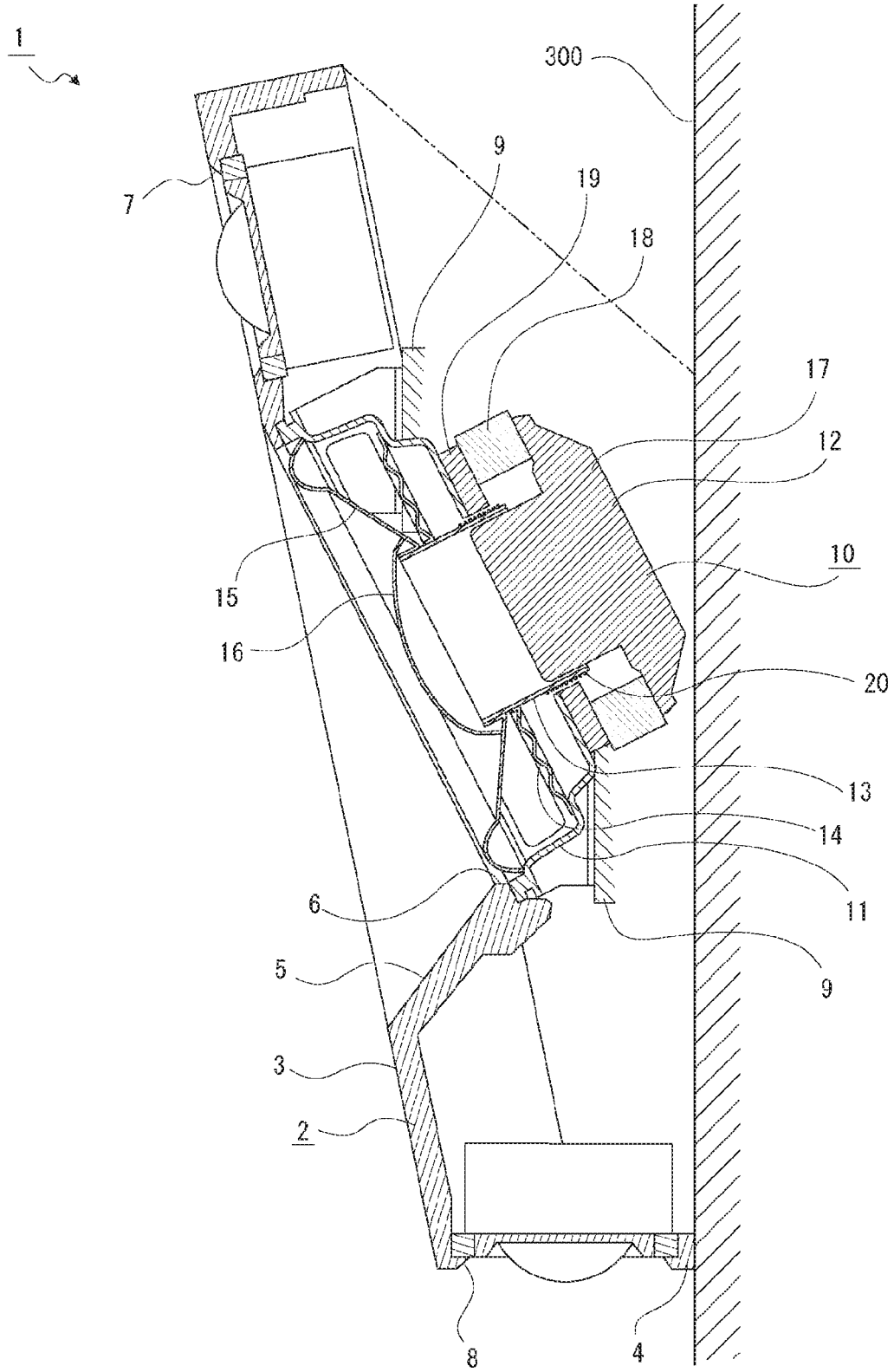
FIG. 9 is a cross-sectional view illustrating an example in which the acoustic device is used in a wall-mounted state.
Figure 10:
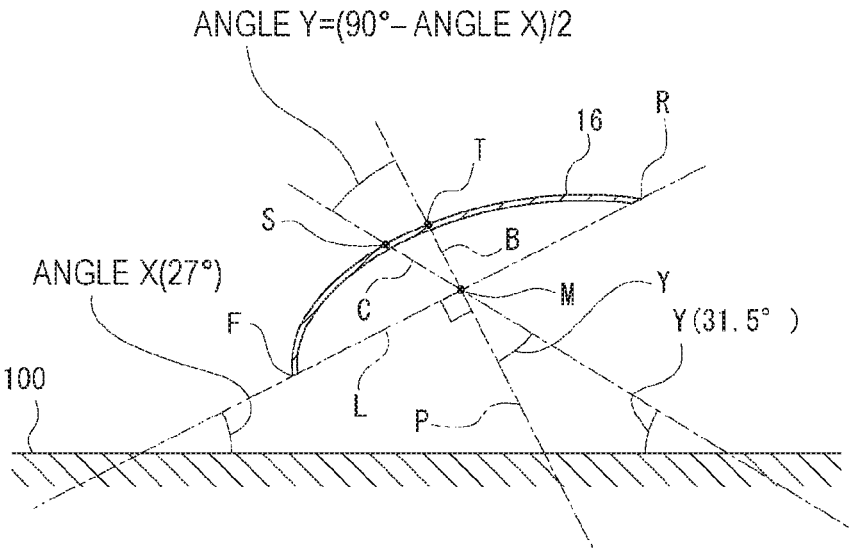
FIG. 10 is a schematic diagram illustrating each angle and the like in a state in which the acoustic device is placed on a placement surface.
Figure 11:
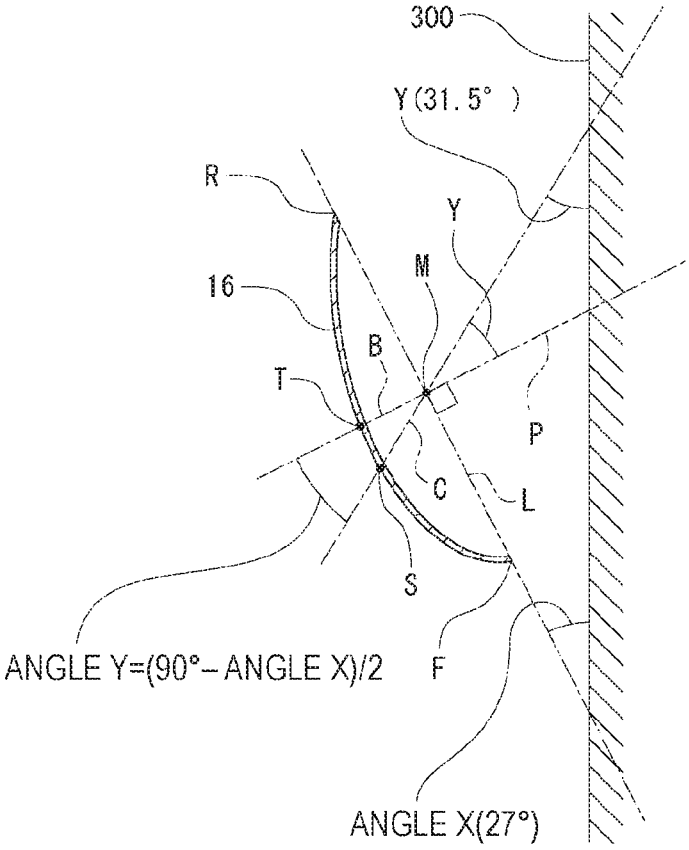
FIG. 11 is a schematic diagram illustrating each angle and the like in a state in which the acoustic device is attached to a wall surface.

As described above, the acoustic device 1 can also be used, for example, in a second direction of a wall hanging state of being attached to a wall surface 300 via a bracket (not illustrated) (see FIG. 9), in addition to usage in the first direction in a state of being placed on the placement surface 100. Accordingly, the acoustic device 1 is used in a direction different by approximately 90° of a state of being placed on the placement surface 100 and a state of being attached to the wall surface 300.

As described above, the cap 16 is configured such that the eccentric point S exists at a position where the line segment B is inclined by an angle Y of (90°−angle X)/2. The inclined angle (31.5°) of the line segment C with respect to the placement surface 100 is the same as the inclined angle of the line segment C with respect to the center axis P, and the inclined angle (31.5°) of the line segment C with respect to the wall surface 300 is the same as the inclined angle of the line segment C with respect to the center axis P.

Accordingly, it is easy to control the directivity of the acoustic device 1 when the acoustic device 1 is used in a state of being attached to the wall surface 300 in a direction of a different angle by approximately 90° from when the acoustic device 1 is used in a state of being placed on the placement surface 100 and when the acoustic device 1 is placed on the placement surface 100, and it is possible to perform an appropriate design considering a plurality of usage states of the acoustic device 1.

<Present Technology>

The present technology can be configured as follows.

(1) A speaker unit including:

a vibration plate;

a magnetic circuit;

a bobbin to which an inner peripheral portion of the vibration plate is attached and which is varied in an axial direction by the magnetic circuit; and a cap attached to the vibration plate and located to face the bobbin in the axial direction of the bobbin, in which a center axis of the bobbin is arranged in a state of being inclined with respect to a horizontal plane or a vertical plane, and the cap is formed in a shape eccentric to the center axis of the bobbin.

(2) The speaker unit according to (1), in which a direction which connects the center axis and an eccentric point of the cap coincides with an inclined direction of the center axis with respect to the horizontal plane or the vertical plane.

(3) The speaker unit according to (2), in which the cap is formed in a shape eccentric to a front side with respect to the center axis.

(4) The speaker unit according to (3), in which, in a predetermined line segment passing through the eccentric point on an outer surface of the cap, one of the line segment is formed in an arc shape with the eccentric point as a reference, and the other of the line segment is formed as a curved line in which a curvature increases as the other of the line segment is separated from the eccentric point.

(5) The speaker unit according to (4), in which the predetermined line segment is set as a line segment included in a center plane in a right-left direction.

(6) The speaker unit according to (5), in which a line segment on a rear side with the eccentric point as a reference is formed in an arc shape, and a line segment on a front side with the eccentric point as a reference is formed as a curved line in which the curvature increases as the line segment is separated from the eccentric point.

(7) The speaker unit according to any of (3) to (6), in which when an inclination angle of the center axis with respect to the horizontal plane or the vertical plane is set as an angle X, a line segment which connects one end and the other end in a direction connecting the center axis of the cap and the eccentric point is set as a coupling line, a line segment passing through an intermediate point of the coupling line and extending in the axial direction of the center axis is set as a line segment B, and a line segment obtained by inclining the line segment B by an angle of (90°−angle X)/2 with the intermediate point as a reference is set as a line segment C, the eccentric point exists on the line segment C.

(8) The speaker unit according to any of (1) to (7), further including:

a frame to which an edge of the vibration plate is attached, the frame being provided with an attachment target portion attached to the housing of the acoustic device in the inclined state.

(9) An acoustic device including:

a speaker unit which outputs sound; and a housing to which the speaker unit is attached, in which the speaker unit includes a vibration plate, a magnetic circuit, a bobbin to which an inner peripheral portion of the vibration plate is attached and which is varied in an axial direction by the magnetic circuit, and a cap attached to the vibration plate and located to face the bobbin in the axial direction of the bobbin, a center axis of the bobbin is arranged in a state of being inclined with respect to a horizontal plane or a vertical plane, and the cap is formed in a shape eccentric to the center axis of the bobbin.

(10) The acoustic device according to (9), in which a direction which connects the center axis and an eccentric point of the cap coincides with an inclined direction of the center axis with respect to the horizontal plane or the vertical plane.

(11) The acoustic device according to (10), in which the cap is formed in a shape eccentric to a front side with respect to the center axis.

(12) The acoustic device according to (11), in which, in a predetermined line segment passing through the eccentric point on an outer surface of the cap, one of the line segment is formed in an arc shape with the eccentric point as a reference, and the other of the line segment is formed as a curved line in which a curvature increases as the other of the line segment is separated from the eccentric point.

(13) The acoustic device according to (12), in which the predetermined line segment is set as a line segment included in a center plane in a right-left direction.

(14) The acoustic device according to (13), in which a line segment on a rear side with the eccentric point as a reference is formed in an arc shape, and a line segment on a front side with the eccentric point as a reference is formed as a curved line in which the curvature increases as the line segment is separated from the eccentric point.

(15) The acoustic device according to any of (11) to (14), in which when an inclination angle of the center axis with respect to the horizontal plane or the vertical plane is set as an angle X, a line segment which connects one end and the other end in a direction connecting the center axis of the cap and the eccentric point is set as a coupling line, a line segment passing through an intermediate point of the coupling line and extending in the axial direction of the center axis is set as a line segment B, and a line segment obtained by inclining the line segment B by an angle of (90°−angle X)/2 with the intermediate point as a reference is set as a line segment C, the eccentric point exists on the line segment C.

(16) The acoustic device according to any of (9) to (15), further including:

a frame to which an edge of the vibration plate is attached, the frame being provided with an attachment target portion attached to the housing of the acoustic device in the inclined state.

(17) The acoustic device according to any of (9) to (16), in which the acoustic device is usable in a first direction placed on a placement surface and in a second direction different by approximately 90° from the first direction.

REFERENCE SIGNS LIST

1 Acoustic device
2 Housing
10 Speaker unit
11 Frame
11*e* Attachment target portion
12 Magnetic circuit
13 Bobbin
15 Vibration plate
15*a* Edge
16 Cap
23 Outer surface
H Horizontal plane
V Vertical plane
P Center axis
S Eccentric point
Q Intersection line
F Front end
R Rear end
L Coupling line
M Intermediate point B Line segment
C Line segment

The invention claimed is:

1. A speaker unit, comprising:
a vibration plate;
a magnetic circuit;
a bobbin attached to an inner peripheral portion of the vibration plate, wherein the bobbin is varied in an axial direction of the bobbin by the magnetic circuit; and
a cap attached to the vibration plate, wherein
the cap faces the bobbin in the axial direction of the bobbin,
a center axis of the bobbin is in an inclined state with respect to a horizontal plane or a vertical plane,
the cap is in a shape eccentric to the center axis of the bobbin, and
in a determined line segment passing through an eccentric point on an outer surface of the cap, a first line segment is in an arc shape with the eccentric point as a reference and a second line segment is a curved line in which a curvature increases as the second line segment is separated from the eccentric point.

2. The speaker unit according to claim 1, wherein
a direction which connects the center axis and the eccentric point of the cap coincides with an inclined direction of the center axis with respect to the horizontal plane or the vertical plane.

3. The speaker unit according to claim 1, wherein the cap is in a shape eccentric to a front side with respect to the center axis.

4. The speaker unit according to claim 1, wherein the determined line segment is set as a line segment included in a center plane in a right-left direction.

5. The speaker unit according to claim 1, wherein
a third line segment on a rear side with the eccentric point as a reference is in an arc shape, and
a fourth line segment on a front side with the eccentric point as a reference is a curved line in which the curvature increases as the fourth line segment is separated from the eccentric point.

6. The speaker unit according to claim 3, wherein
an inclination angle of the center axis with respect to the horizontal plane or the vertical plane is set as an angle X,
a coupling line connects a front end of the determined line segment and a rear end of the determined line segment,
the coupling line passes through the center axis of the cap,
a third line segment passes through an intermediate point of the coupling line,
the third line segment extends in an axial direction of the center axis,
the third line segment is set as a line segment B,
a fourth line segment is obtained based on an inclination of the line segment B by an angle of (90°−angle X)/2 with the intermediate point as a reference,
the fourth line segment is set as a line segment C, and
the eccentric point exists on the line segment C.

7. The speaker unit according to claim 1, further comprising:
a frame attached to an edge of the vibration plate, wherein the frame comprises an attachment target portion attached to a housing of an acoustic device in the inclined state.

8. An acoustic device, comprising:
a speaker unit configured to output sound; and
a housing attached to the speaker unit,
wherein the speaker unit includes:
a vibration plate,
a magnetic circuit,
a bobbin attached to an inner peripheral portion of the vibration plate, wherein the bobbin is varied in an axial direction of the bobbin by the magnetic circuit, and
a cap attached to the vibration plate, wherein
the cap faces the bobbin in the axial direction of the bobbin,
a center axis of the bobbin is in an inclined state with respect to a horizontal plane or a vertical plane,
the cap is in a shape eccentric to the center axis of the bobbin, and
in a determined line segment passing through an eccentric point on an outer surface of the cap, a first line segment is in an arc shape with the eccentric point as a reference and a second line segment is a curved line in which a curvature increases as the second line segment is separated from the eccentric point.

9. The acoustic device according to claim 8, wherein
a direction which connects the center axis and the eccentric point of the cap coincides with an inclined direction of the center axis with respect to the horizontal plane or the vertical plane.

10. The acoustic device according to claim 8, the cap is in a shape eccentric to a front side with respect to the center axis.

11. The acoustic device according to claim 8, wherein the determined line segment is set as a line segment included in a center plane in a right-left direction.

12. The acoustic device according to claim 8, wherein
a third line segment on a rear side with the eccentric point as a reference is in an arc shape, and
a fourth line segment on a front side with the eccentric point as a reference is a curved line in which the curvature increases as the fourth line segment is separated from the eccentric point.

13. The acoustic device according to claim 10, wherein
an inclination angle of the center axis with respect to the horizontal plane or the vertical plane is set as an angle X,
a coupling line connects a front end of the determined line segment and a rear end of the determined line segment,
the coupling line passes through the center axis of the cap,
a third line segment passes through an intermediate point of the coupling line,
the third line segment extends in an axial direction of the center axis,
the third line segment is set as a line segment B,
a fourth line segment is obtained based on an inclination of the line segment B by an angle of (90°−angle X)/2 with the intermediate point as a reference,
the fourth line segment is set as a line segment C, and
the eccentric point exists on the line segment C.

14. The acoustic device according to claim 8, further comprising:
a frame attached to an edge of the vibration plate, wherein the frame comprises an attachment target portion, and the attachment target portion is attached to the housing of the acoustic device in the inclined state.

15. The acoustic device according to claim 8, wherein the acoustic device is usable in a first direction placed on a placement surface and in a second direction different by approximately 90° from the first direction.

16. A speaker unit, comprising:
a vibration plate;

a magnetic circuit;

a bobbin attached to an inner peripheral portion of the vibration plate, wherein the bobbin is varied in an axial direction of the bobbin by the magnetic circuit; and a cap attached to the vibration plate, wherein the cap faces the bobbin in the axial direction of the bobbin, a center axis of the bobbin is in an inclined state with respect to a horizontal plane or a vertical plane, the cap is in a shape eccentric to the center axis of the bobbin, the cap is in a shape eccentric to a front side with respect to the center axis, in a determined line segment passing through an eccentric point on an outer surface of the cap, a first line segment is in an arc shape with the eccentric point as a reference and a second line segment is a curved line in which a curvature increases as the second line segment is separated from the eccentric point, and a direction which connects the center axis and the eccentric point of the cap coincides with an inclined direction of the center axis with respect to the horizontal plane or the vertical plane.

* * * * *